US008604904B2

(12) United States Patent
Fujimoto et al.

(10) Patent No.: US 8,604,904 B2
(45) Date of Patent: Dec. 10, 2013

(54) PORTABLE DEVICE

(75) Inventors: Akihiro Fujimoto, Seto (JP); Masahiro Yamamoto, Kasugai (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 1037 days.

(21) Appl. No.: 12/275,814

(22) Filed: Nov. 21, 2008

(65) Prior Publication Data

US 2009/0128288 A1 May 21, 2009

(30) Foreign Application Priority Data

Nov. 21, 2007 (JP) ..... 2007-301873

(51) Int. Cl.
*G05B 19/00* (2006.01)

(52) U.S. Cl.
USPC ..... 340/5.62; 340/5.64; 340/12.55; 455/128; 455/90.3

(58) Field of Classification Search
USPC ..... 340/5.64, 5.61; 455/575.1, 90.3, 128; 361/679, 683
See application file for complete search history.

(56) References Cited

U.S. PATENT DOCUMENTS

| | | | | |
|---|---|---|---|---|
| 3,649,999 | A * | 3/1972 | Stoffel | 24/635 |
| 4,635,167 | A * | 1/1987 | Schlosser | 362/85 |
| 4,689,455 | A * | 8/1987 | Watanabe | 200/534 |
| 7,166,812 | B2 * | 1/2007 | White et al. | 200/341 |
| 7,248,201 | B2 * | 7/2007 | Buccinna et al. | 341/176 |
| 2002/0008610 | A1 * | 1/2002 | Peterson | 340/5.64 |
| 2003/0210514 | A1 * | 11/2003 | Liu et al. | 361/683 |
| 2006/0281501 | A1 * | 12/2006 | Zuo et al. | 455/575.1 |
| 2009/0301853 | A1 * | 12/2009 | Yang et al. | 200/343 |
| 2009/0301854 | A1 * | 12/2009 | Yang et al. | 200/343 |
| 2011/0036693 | A1 * | 2/2011 | Lin et al. | 200/314 |
| 2011/0067363 | A1 * | 3/2011 | Sprada et al. | 53/492 |
| 2011/0185838 | A1 * | 8/2011 | Yang et al. | 74/491 |
| 2011/0235828 | A1 * | 9/2011 | Chang | 381/123 |

FOREIGN PATENT DOCUMENTS

| | | | |
|---|---|---|---|
| JP | 9082170 | A | 3/1997 |
| JP | 2000332427 | A | 11/2000 |

OTHER PUBLICATIONS

Office Action Issued in Japanese Application No. 2007-301873, Dated Nov. 15, 2011 (4 Pages With English Translation).
English Patent Abstract of JP 2000332427 from esp@cenet, Publication Date: Nov. 30, 2000 (1 Page).
English Patent Abstract of JP 9082170, from esp@cenet, Publication Date: Mar. 28, 1997 (1 Page).

* cited by examiner

*Primary Examiner* — Jennifer Mehmood
*Assistant Examiner* — Rufus Point
(74) *Attorney, Agent, or Firm* — Osha Liang LLP

(57) ABSTRACT

A portable device has an opening formed in one case of a dual structure, a partitioning member for partitioning the opening, a projection formed on the partitioning member so as to project to a front surface side of the case, and at least two push buttons attached from a back surface side of the case to partitions partitioned by the partitioning member. The push button has a substantially flat plate-shaped push button portion, and a locking portion formed at an outer edge of the push button portion. The locking portion contacts an outer edge of the opening to prevent slip-out of the push button when the push button is attached to the partition from the back surface side of the case.

2 Claims, 10 Drawing Sheets

PORTABLE DEVICE

BACKGROUND OF THE INVENTION

1. Technical Field

The present invention relates to a portable device, for example, a portable device used as a remote controller in a remote keyless entry system and the like of a vehicle such as an automobile.

2. Related Art

A remote keyless entry system is a convenient system for locking/unlocking the door, and the like without using a mechanical key by simply operating a push button of the remote controller (hereinafter referred to as portable device), where the portable device for the remote keyless entry system is generally arranged with a plurality of push buttons for various applications such as for locking/unlocking the door, and for opening/closing a slide door.

In this type of portable device, efforts have been made to avoid misoperations of the push button, and a portable device arranged with a "projection" between each push button is disclosed as one example in Design Registration No. 1221519.

FIGS. 9A and 9B show outer appearance views of a portable device of the related art. This figure corresponds to a "front view" and a "right side view" of Design Registration No. 1221519. A portable device 1 is configured to be arranged with a plurality of, or three herein, push buttons (hereinafter referred to as first push button 3, second push button 4, third push button 5) on a front surface of a small main body 2 suitable for carrying around. The first push button 3 is for locking the door, the second push button 4 is for unlocking the door, and the third push button 5 is for opening/closing the slide door.

In the portable device 1 of such configuration, one may open the slide door by mistake when intending to unlock the door if the push button is operated in a dark place, for example, at night. That is, one should push the second push button 4, but may mistakenly push the adjacent third push button 5.

In order to avoid such a drawback, in the related art, a horizontally long projection (hereinafter referred to as first projection 6, second projection 7) is arranged between the first push button 3 and the second push button 4, and between the second push button 4 and the third push button 5, respectively. Thus, when operating the push button in a dark place, one will first touch the first and second projections 6, 7 thereby understanding the positional relationship of the three push buttons (first push button 3, second push button 4, third push button 5), and then search for the target push button, thereby avoiding mistaken operation.

A longitudinal dimension X of the first and second projections 6, 7 is slightly smaller than a lateral dimension Y of each push button (representatively second button 4), and furthermore, the first projection 6 is positioned between two corners 3*a* on the lower side (each top, bottom, left, and right direction herein follows the direction of the drawing unless particularly stated) of the first push button 3 and two corners 4*a* on the upper side of the second push button 4, and the second projection 7 is positioned between two corners 4*b* on the lower side of the second push button 4 and two corners 5*a* on the upper side of the third push button 5. Thus, short projections (first and second projections 6, 7) of Y>X are arranged between the three push buttons (first to third push buttons 3 to 5), and each corner of the three push buttons (first to third push buttons 3 to 5) are arranged next to each other in an extra portion of Y-X, which is a demand in design to create "a sense of unity" on the three push buttons.

SUMMARY

In a related art, an aspect of arranging projections (first and second projections 6, 7) between each push button is described, but how to incorporate three push buttons (first to third push buttons 3 to 5) in a main body 2 is not described, and thus, drawbacks described below arise in manufacturing.

In FIG. 9, the first and second projections 6, 7 are both molded integrally with the main body 2. The first to third push buttons 3 to 5 are all attached to push button holes (not shown) opened in the main body 2.

The first to third push buttons 3 to 5 should, obviously, be performed with some kind of a slip-out prevention measure so as not to naturally fall out after the attachment. This measure is not clearly indicated in FIG. 9, but is assumed to be the following.

FIGS. 10A and 10B show cross-sectional views showing the slip-out prevention measures of the related art. In the figure, FIG. 10A shows the slip-out prevention measure of attaching the first to third push buttons 3 to 5 slightly larger than a push button hole 2*a* from a "back surface side" of the main body 2. This measure is hereinafter referred to as a first slip-out prevention measure. FIG. 10B shows the slip-out prevention measure of attaching the first to third push buttons 3 to 5 from a "front surface side" of the main body 2, inserting slip-out prevention plates 3*a*, 4*a*, and 5*a* slightly larger than the push button hole 2*a* from the "back surface side" of the main body 2, and fixing the slip-out prevention plates 3*a*, 4*a*, and 5*a* and the first to third push buttons 3 to 5 by adhesion, by screw, and the like. This measure is hereinafter referred to as a second slip-out prevention measure.

In the first slip-out prevention measure, however, the size of the first to third push buttons 3 to 5 facing the front surface side of the main body 2 cannot be made greater than or equal to the size of the push button hole 2*a*, and thus the demand in design, that is, arranging the corner of each push button (two corners 3*a* on the lower side of the first push button 3, two corners 4*a* on the upper side of the second push button 4, two corners 4*b* on the lower side of the second push button 4, and two corners 5*a* on the upper side of the third push button 5) next to the projections (first and second projections 6, 7) cannot be achieved.

In the second slip-out prevention measure, the demand in design can be responded, but the cost increases since the fixing task of the slip-out prevention plates 3*a*, 4*a*, 5*a* and the first to third push buttons 3 to 5 is required in addition to the increase in parts such as the slip-out prevention plates 3*a*, 4*a*, 5*a*, screws, and the like.

One or more embodiments of the present invention provides a portable device that does not lead to an increase in cost in manufacturing.

In accordance with a first aspect of the present invention, a portable device includes an opening formed in one case of a dual structure; a partitioning member for partitioning the opening; a projection formed on the partitioning member so as to project to a front surface side of the case; and at least two push buttons attached from a back surface side of the case to partitions partitioned by the partitioning member; wherein the push button includes a substantially flat plate-shaped push button portion, and a locking portion formed at an outer edge of the push button portion; and the locking portion contacts an outer edge of the opening to prevent slip-out of the push button when the push button is attached to the partition from the back surface side of the case.

In accordance with a second aspect of the present invention, the portable device of the first aspect of the present invention, wherein the locking portion also functions to align the push button with respect to the partition.

In one or more embodiments of the present invention, measures for preventing slip-out of the push button is taken by the locking portion when the push button is attached to the partition from the back surface side of the case, and thus an increase in man-hour and an increase in the number of parts such as in screw fixation in the second slip-out prevention measure are eliminated, and the portable device that does not lead to an increase in cost in manufacturing can be provided.

DETAILED DESCRIPTION

An embodiment of the present invention will be described based on the drawings using an application to a remote controller (hereinafter referred to as portable device) of a remote keyless entry system by way of example.

An outer appearance of the portable device according to the present embodiment will be first described.

Figure 1A:
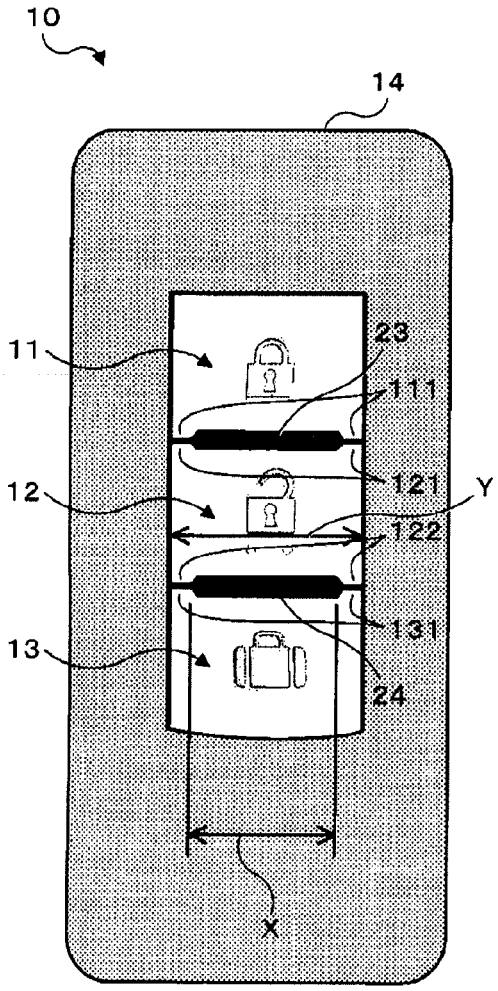
FIGS. 1A and 1B show front views of a portable device 10 of the present embodiment.
Figure 1B:
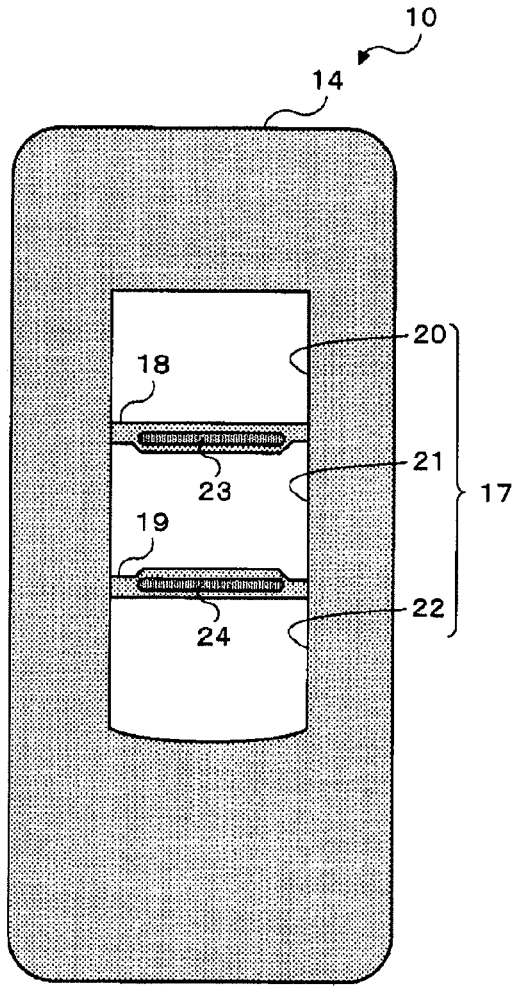

FIGS. 1A and 1B show front views of a portable device 10, where FIG. 1A is a view showing the portable device 10 after attaching three push buttons (first push button 11 to third push button 13), and FIG. 1B is a view showing the portable device 10 before attaching the three push buttons (first push button 11 to third push button 13). In the following description, the portable device 10 equipped with the three push buttons is given by way of example, but is not limited thereto. The number of push buttons merely needs to be in plurals (at least two).

Figure 2:
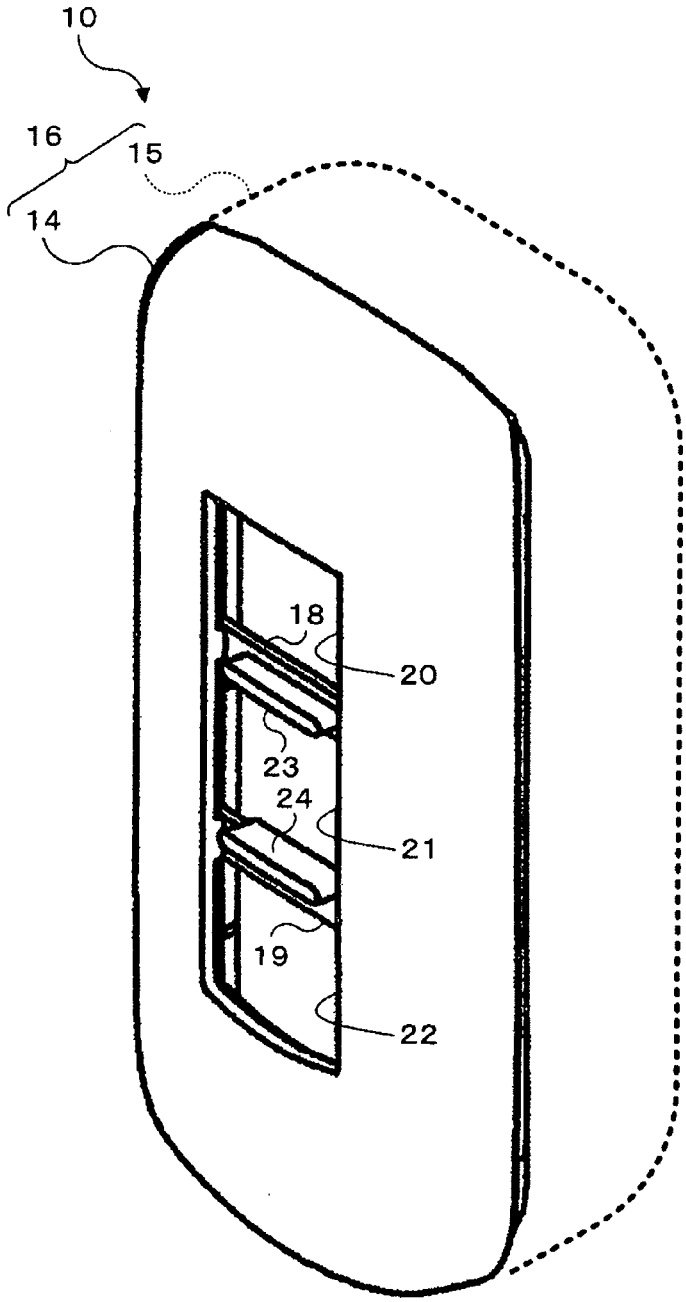
FIG. 2 shows an outer appearance view of the portable device 10 corresponding to FIG. 1B.

FIG. 2 shows an outer appearance view of the portable device 10 corresponding to FIG. 1B. As shown in the figure, the portable device 10 includes a main body 16 of a dual structure including an upper case 14 and a lower case 15. The lower case 15 is for mounting an electronic substrate, a battery, or the like (not shown), but the description will not be given herein since it is not directly related to the present invention.

In FIGS. 1 and 2, a vertically long opening 17 is formed on a front surface (surface) of the upper case 14, which opening 17 is partitioned into three partitions (hereinafter referred to as first partition 20, second partition 21, third partition 22) by two partitioning members (hereinafter referred to as first partitioning member 18, second partitioning member 19) integrally molded with the upper case 14, and each partition 20 to 22 is used as an attachment hole of the first push button 11, an attachment hole of the second push button 12, and an attachment hole of the third push button 13.

The first partitioning member 18 and the second partitioning member 19 are integrally formed with a first projection 23 and a second projection 24, respectively. Such projections (first projection 23, second projection 24) correspond to a first projection 6 and a second projection 7 of the related art described at the beginning, where a longitudinal dimension X of a first projection 23 and a second projection 24 is in a relationship of "Y>X" smaller than a lateral dimension Y of the three push buttons (first to three push buttons 11 to 13), and corners (two corners 111 on the lower side of the first push button 11, two corners 121 on the upper side of the second push button 12, two corners 122 on the lower side of the second push button 12, two corners 131 on the upper side of the third push button 13) of the three push buttons (first to three push buttons 11 to 13) are arranged at a remaining portion of Y-X, similar to the related art. This complies with "demand in design" described at the beginning.

Figure 3:
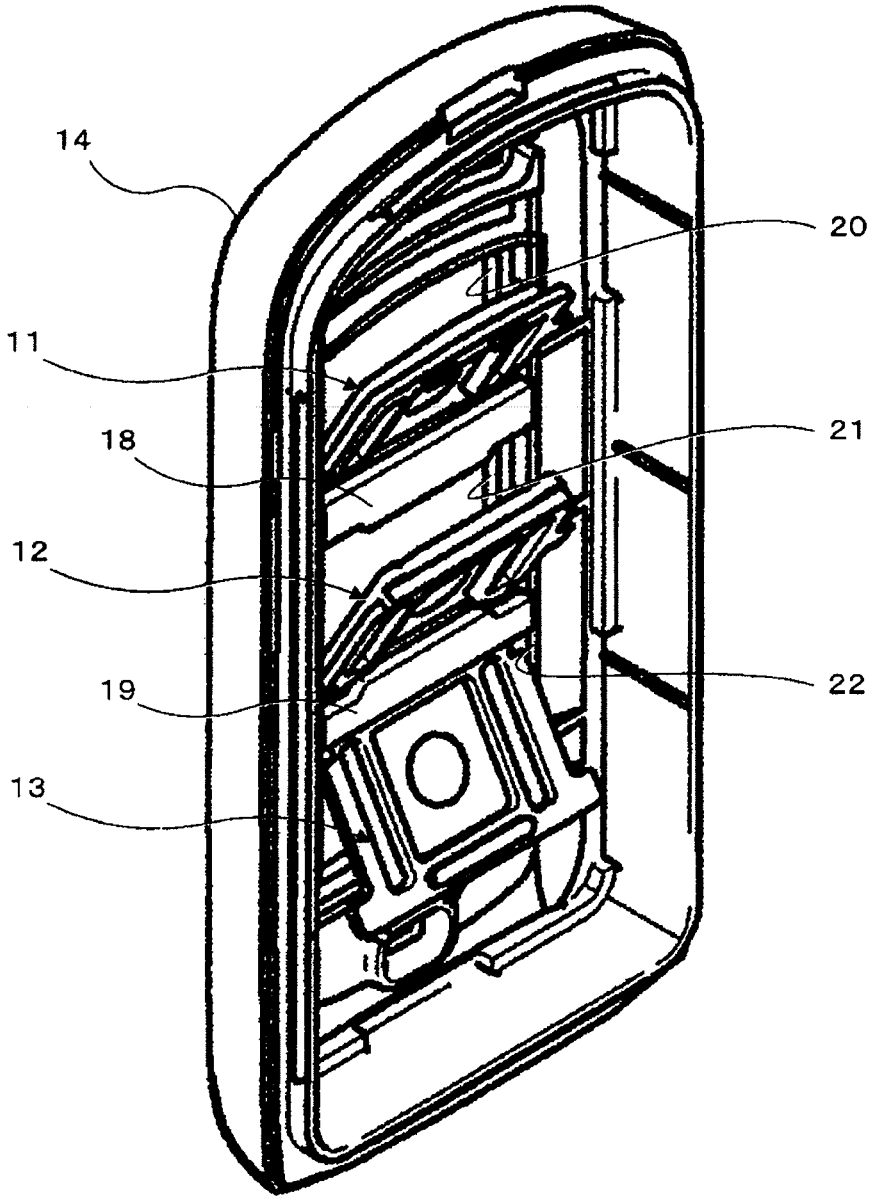
FIG. 3 shows a rear perspective view of an upper case 14.

FIG. 3 shows a rear perspective view of the upper case 14. As shown in the figure, three push buttons (first push button 11, second push button 12, third push button 13) are inserted from a rear surface side of the upper case 14, and the respective push buttons are sequentially (in random order) attached to the first partition 20, the second partition 21, and the third partition 22 in a tilted manner as shown in the figure.

The structure of the push button will be described below.

Figure 4A:
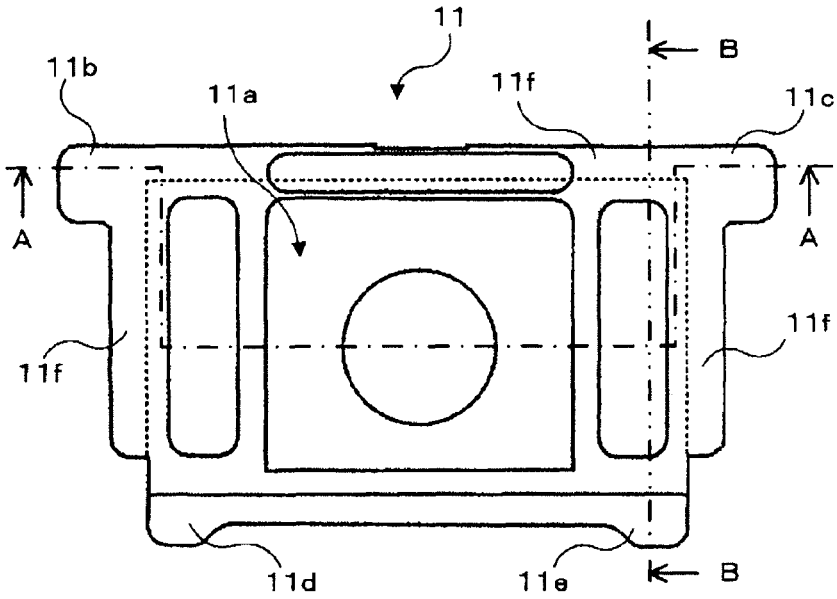
FIGS. 4A to 4C respectively show a rear view of a first push button 11, a cross-sectional view taken along line A-A, and a cross-sectional view taken along line B-B.
Figure 4C:
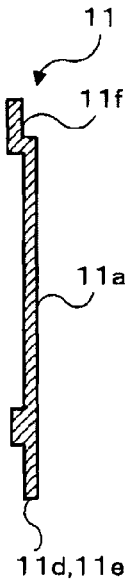
Figure 4B:
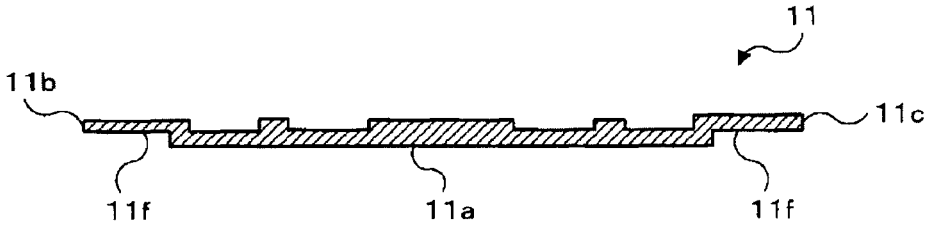

FIGS. 4A to 4C respectively show a rear view of the first push button 11, a cross-sectional view taken along line A-A, and a cross-sectional view taken along line B-B. The first push button 11 includes a push button portion 11*a* having a substantially flat plate-shape integrally molded from plastic raw material and the like, and includes tongue-shaped locking portions 11*b*, 11*c* projecting to the left and the right from the upper part of the left and right outer edges of the push button portion 11*a*, tongue-shaped locking portions 11*d*, 11*e* projecting to the lower side from both ends of the lower outer edge, and thin-thickness portions 11*f*, 11*f* formed at one part of the upper outer edge and the left and right outer edges of the push button portion 11*a* so as to include the locking portions 11*b*, 11*c*.

Figure 5A:
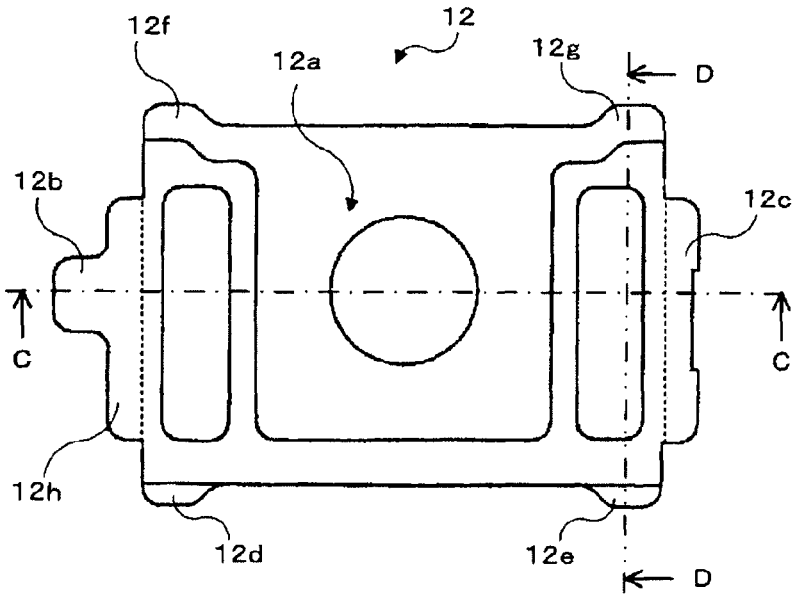
FIGS. 5A to 5C respectively show a rear view of a second push button 12, a cross-sectional view taken along line C-C, and a cross-sectional view taken along line D-D.
Figure 5C:
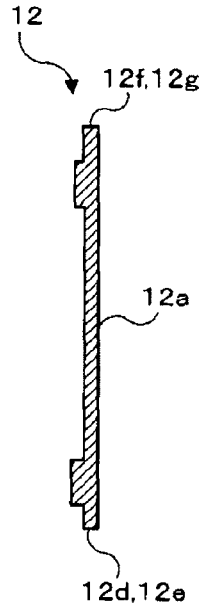
Figure 5B:
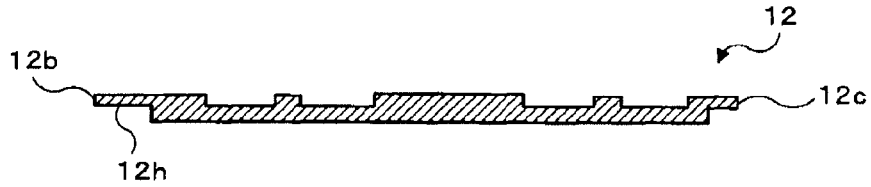

FIGS. 5A to 5C respectively show a rear view of the second push button 12, a cross-sectional view taken along line C-C, and a cross-sectional view taken along line D-D. The second push button 12 includes a push button portion 12*a* having a substantially flat plate-shape integrally molded from plastic raw material and the like, and includes a tongue-shaped locking portion 12*b* projecting to the left from substantially the middle of the left outer edge of the push button 12*a*, a tongue-shaped locking portion 12*c* projecting to the right from the right outer edge of the push button 12*a*, tongue-shaped locking portions 12*d*, 12*e* projecting to the lower side from both ends of the lower outer edge, tongue-shaped locking portions 12*f*, 12*g* projecting to the upper side from both ends of the upper outer edge, and a thin-thickness portion 12*h* formed at one part of the left outer edge of the push button portion 12*a* so as to include the locking portion 12*b*.

Figure 6A:
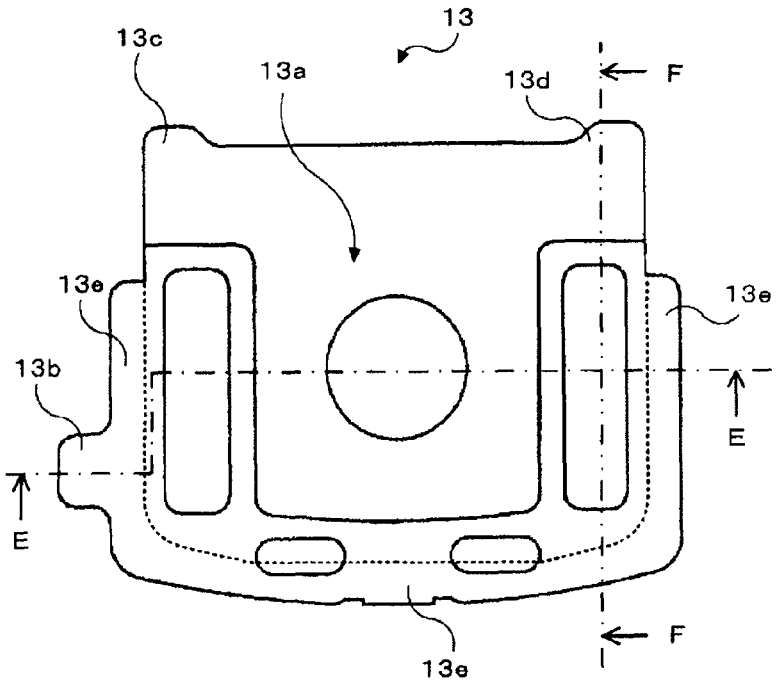
FIGS. 6A to 6C respectively show a rear view of a third push button 13, a cross-sectional view taken along line E-E, and a cross-sectional view taken along line F-F.
Figure 6C:
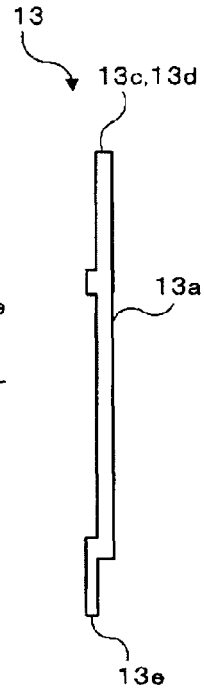
Figure 6B:
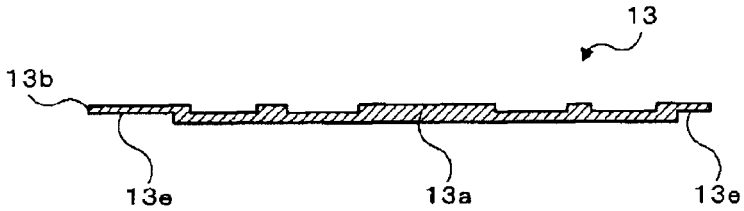

FIGS. 6A to 6C respectively show a rear view of the third push button 13, a cross-sectional view taken along line E-E, and a cross-sectional view taken along line F-F. The third push button 13 includes a push button portion 13*a* having a substantially flat plate-shape integrally molded from plastic raw material and the like, and includes a tongue-shaped locking portion 13*b* projecting to the left from the vicinity of the lower end of the left outer edge of the push button portion 13*a*, tongue-shaped locking portions 13*c*, 13*d* projecting to the upper side from both ends of the upper outer edge of the push button 13*a*, and thin-thickness portions 13*e*, 13*e* formed at one part of the left and right outer edges and the lower outer edge of the push button portion 13*a* so as to include the locking portion 13*b*.

The relationship between the push buttons and the push button attachment holes (partitions) will be discussed below.

Figure 7:
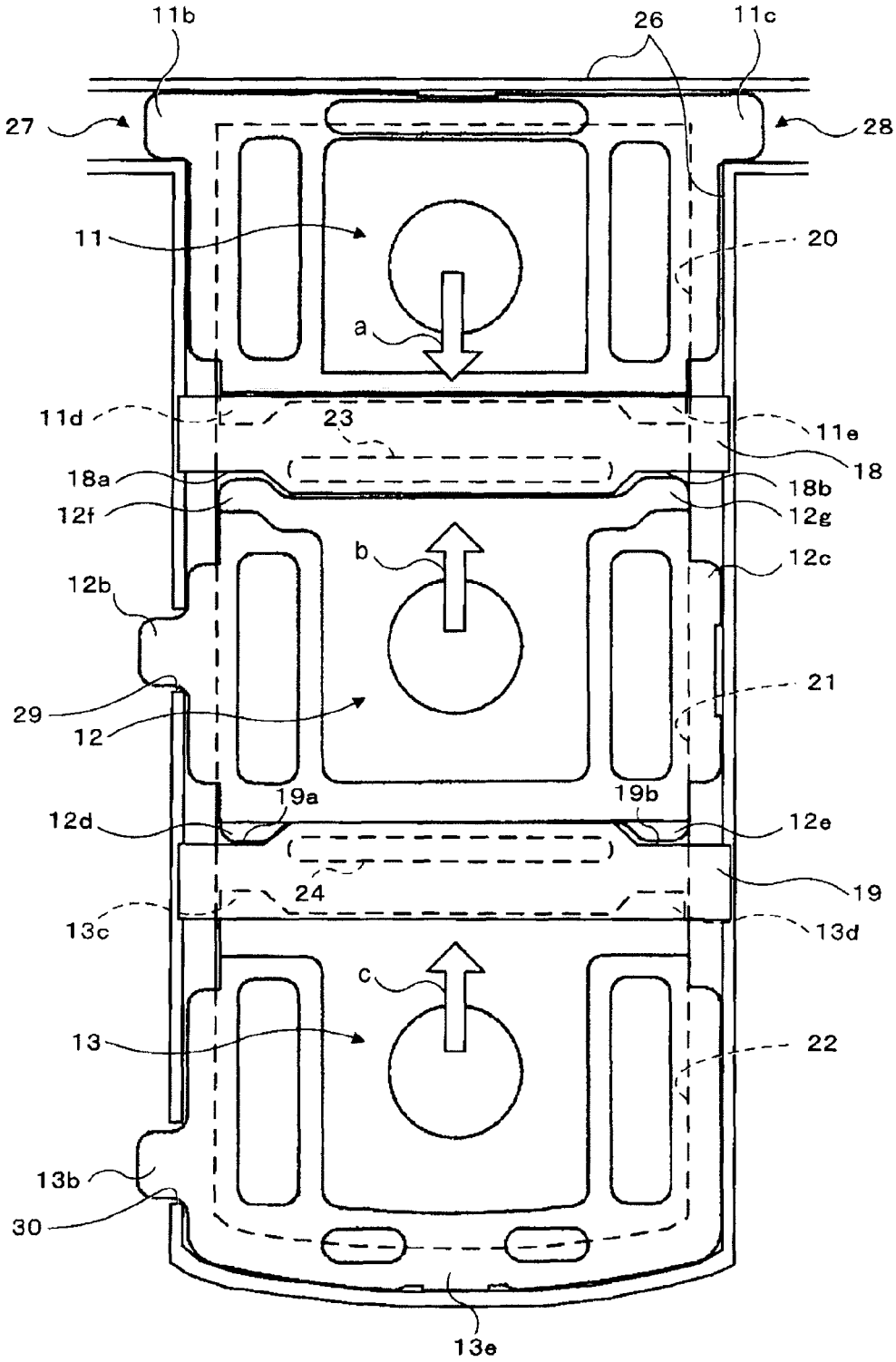
FIG. 7 is a view showing a relationship between the first to third push buttons 11 to 13 and a first to third partitions 20 to 22.

FIG. 7 is a view showing a relationship between the first to third push buttons 11 to 13 and the first to third partitions 20 to 22. This figure is a view of the upper case 14 with the first to third push buttons 11 to 13 attached, seen from a back surface side (rear surface side). The back surface side of the upper case 14 is formed with a wall 26 surrounding the periphery of the first to third partitions 20 to 22, and the attached first to third push buttons 11 to 13 are accommodated on the inner side of the wall 26.

The wall 26 is formed with four open portions (hereinafter referred to as first to fourth open portions 27 to 30) for alignment, where the first and second open portions 27, 28 are for alignment of the first push button 11, the third open portion 29 is for alignment of the second push button 12, and the fourth open portion 30 is for alignment of the third push button 13. In other words, each push button is aligned when the locking portions 11*b*, 11*c*, 12*b*, 13*b* of the first to third push buttons 11 to 13 are accommodated in the respective open portion.

When the first push button 11 is inserted in a direction of an arrow a, that is, when the first push button 11 is inserted from top to bottom in a tilted manner, the locking portions 11*d*, 11*e* at the lower outer edge of the first push button 11 enter the back surface side of the first partitioning member 18, and the first push button 11 is quietly placed in the first partition 20, so that the locking portions 11*b*, 11*c* of the first push button 11 are accommodated in the first and second open portions 27, 28, whereby the first push button 11 is naturally aligned.

Similarly, when the second push button 12 is inserted in a direction of an arrow b, that is, when the second push button 12 is inserted from bottom to top in a tilted manner, the locking portions 12*f*, 12*g* at the upper outer edge of the second push button 12 are brought into contact with cutouts 18*a*, 18*b* on both sides of the first partitioning member 18. The second push button 12 is then quietly placed in the second partition 21, so that the locking portions 12*d*, 12*e* at the lower outer edge of the second push button 12 are brought into contact with cutouts 19*a*, 19*b* on both sides of the second partitioning member 19, and the locking portion 12*b* of the second push button 12 is accommodated in the third open portion 29, whereby the second push button 12 is naturally aligned.

Similarly, when the third push button 13 is inserted in a direction of an arrow c, that is, when the third push button 13 is inserted from bottom to top in a tilted manner, the locking portions 13*c*, 13*e* of the upper outer edge of the third push button 13 enter the back surface side of the second partitioning member 19, and the third push button 13 is quietly placed in the third partition 22, so that the locking portion 13*b* of the third push button 13 is accommodated in the fourth open portion 30, whereby the third push button 13 is naturally aligned.

Figure 8A:
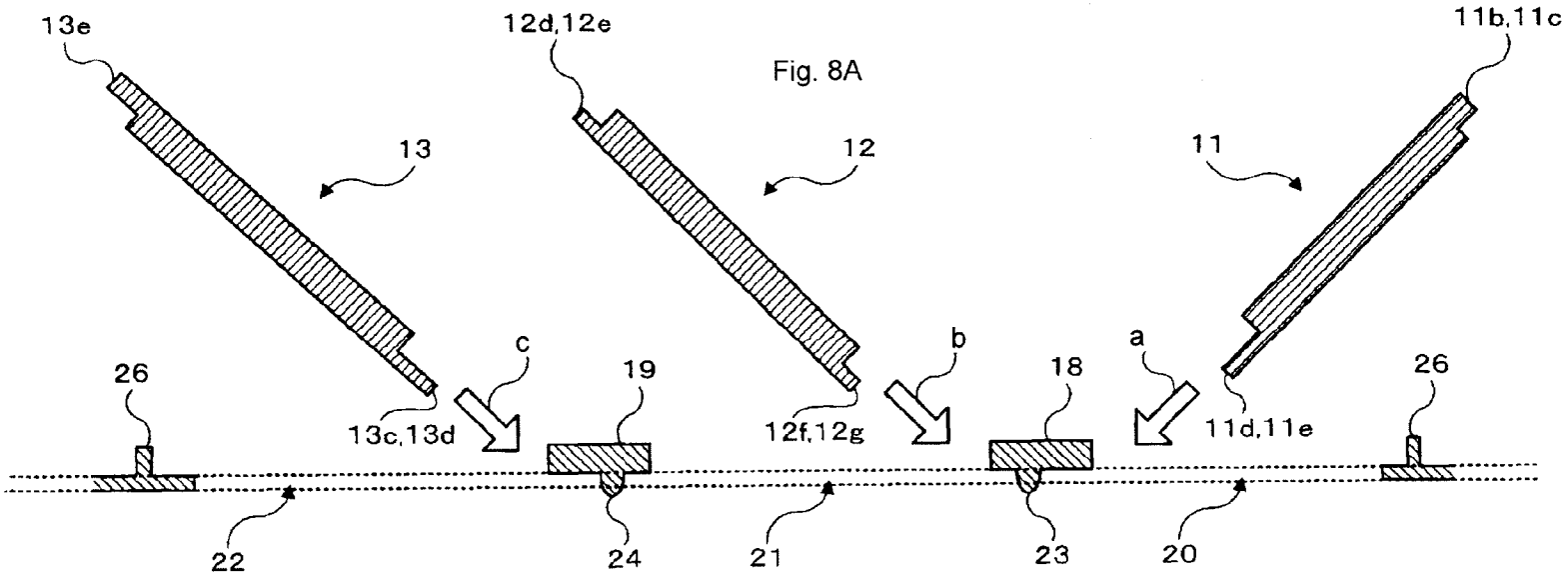
FIGS. 8A and 8B respectively show cross-sectional views of the upper case 14 showing a state when attaching the push buttons, and a state after the attachment.
Figure 8B:
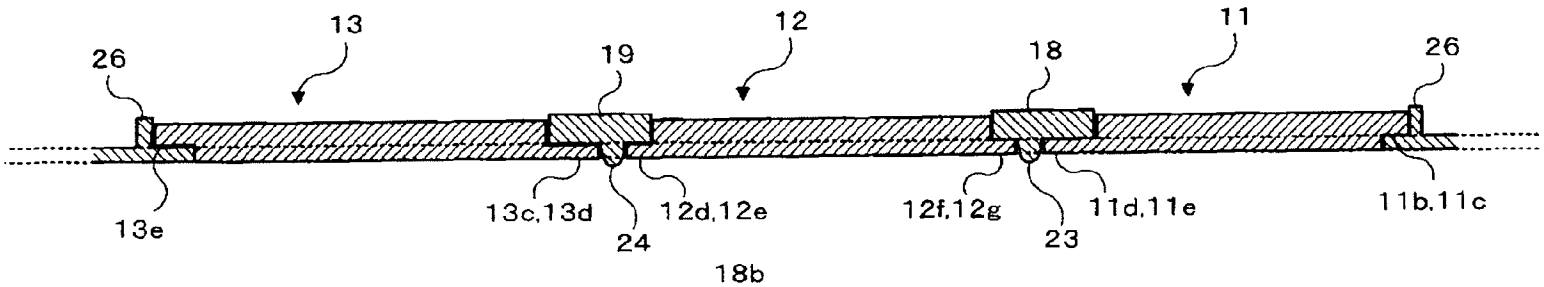
Figure 9A:
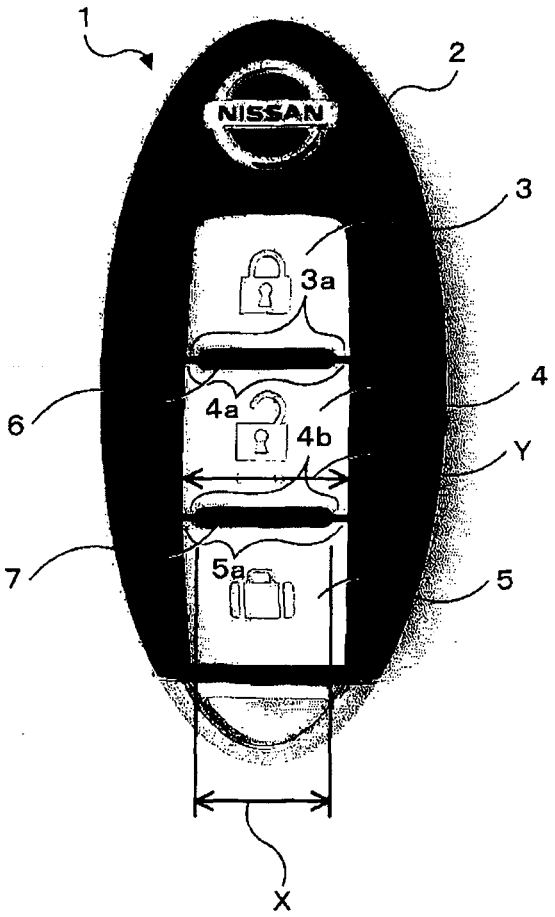
FIGS. 9A and 9B show outer appearance views of a portable device of a related art.
Figure 9B:
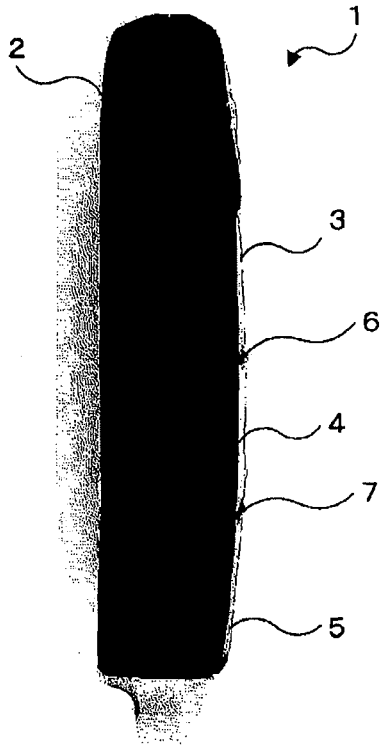
Figure 10A:
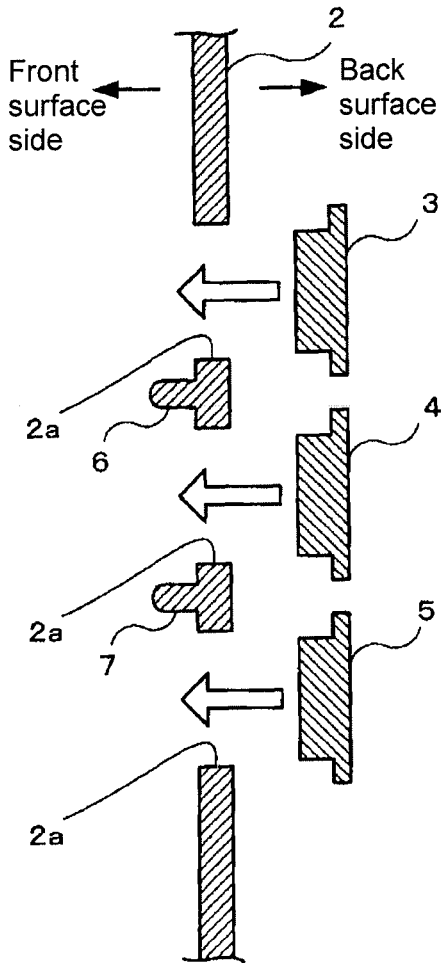
FIGS. 10A and 10B show cross-sectional views showing slip-out prevention measures of the related art.
Figure 10B:
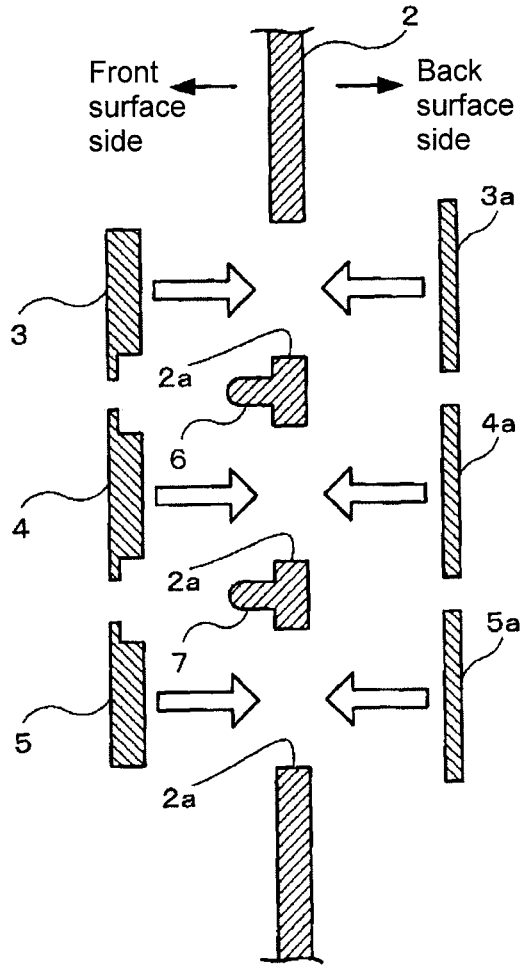

FIGS. 8A and 8B show cross-sectional views of the upper case 14, FIG. 8A showing a state when attaching the push buttons, and FIG. 8B showing a state after the attachment. As shown in the figure, in the present embodiment, (a) the first to third push buttons 11 to 13 after attachment to the upper case 14 have the first projection 23 and the second projection 24 sandwiched (provided in a sandwiched state) between the respective locking portions 11*d*, 11*e*, 12*f*, 12*g*, 12*d*, 12*e*, 13*c*, 13*d*, 13*e*, and thus "demand in design" described at the beginning can be responded. In addition, (b) the first to third push buttons 11 to 13 can be attached with one-touch while taking measures by simply inserting the first to third push buttons 11 to 13 in a tilted manner from a predetermined direction (direction of arrows a to c) from the back surface side of the upper case 14 to the first to third partitions 20 to 22 of the upper case 14, and appropriate effects of not arising drawbacks of a second slip-out prevention measure described at the beginning are obtained, that is, a slip-out prevention plate, a screw, and the like in the related art are unnecessary, and a cost does not increase.

The application to the remote controller of the remote keyless entry system has been described above by way of example, but is should be recognized that the application is not limited thereto. One or more embodiments of the present invention can be widely applied to general portable devices (e.g., remote controller of AV equipment, household electronics, or other electronic devices, or portable electronic devices such as portable information terminal and portable telephone) with a plurality of push buttons and with the above-mentioned "demand in design".

What is claimed is:

1. A portable device comprising:

an opening formed in one case of a dual structure;

a partitioning member for partitioning the opening;

a projection formed on the partitioning member so as to project to a front surface side of the case; and at least two push buttons attached from a back surface side of the case to partitions partitioned by the partitioning member;

wherein each of the push buttons comprises:

a substantially flat plate-shaped push button portion, and a plurality of locking portions formed at an outer edge of the push button portion;

wherein, for one of the at least two push buttons, one of the locking portions contacts an outer edge of the opening of the back side surface of the case, and another of the locking portions contacts the outer edge of the opening of a front side surface of the partitioning member to prevent slip-out of the one push button when the one push button is attached to the partition from the back surface side of the case; and wherein the projection is sandwiched between the locking portion of the one push button and the locking portion of another of the at least two push buttons.

2. The portable device according to claim 1, wherein, for each of the push buttons, the locking portion aligns the push button with respect to the partition.

* * * * *